US006340012B1

(12) United States Patent
Yamashita et al.

(10) Patent No.: US 6,340,012 B1
(45) Date of Patent: Jan. 22, 2002

(54) OIL PAN FOR INTERNAL COMBUSTION ENGINE

(75) Inventors: Akira Yamashita; Masatoshi Omura, both of Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/564,984

(22) Filed: May 5, 2000

(30) Foreign Application Priority Data

May 7, 1999 (JP) ..... 11-126756

(51) Int. Cl.[7] ..... F02F 7/00
(52) U.S. Cl. ..... 123/195 C
(58) Field of Search ..... 123/195 C, 196 R; 184/106

(56) References Cited

U.S. PATENT DOCUMENTS 3,688,871 A * 9/1972 Krestan et al. ..... 184/6.5
4,986,235 A 1/1991 Ishii et al. ..... 123/195 C
5,038,890 A 8/1991 Tanaka et al. ..... 184/6.5
5,058,545 A 10/1991 Hirai et al. ..... 123/195 C
5,103,782 A 4/1992 Matsui ..... 123/195 C
5,465,692 A 11/1995 Uraki et al. ..... 123/195 C
5,852,991 A 12/1998 Yamamura et al. ..... 123/195 C
5,937,817 A * 8/1999 Schanz et al. ..... 123/196 AB
5,960,763 A 10/1999 Yamamura ..... 123/195 C

FOREIGN PATENT DOCUMENTS

JP 7-42523 2/1995

* cited by examiner

*Primary Examiner*—Willis R. Wolfe
*Assistant Examiner*—Hai Huynh
(74) *Attorney, Agent, or Firm*—Foley & Lardner

(57) ABSTRACT

An oil pan for collecting a lubricating oil drained from an internal combustion engine and a lubricating oil dripped from a crankshaft of the engine, is disclosed. The oil pan includes a shallow oil collecting portion, a deep oil collecting portion and baffle plates forming first and second oil passages, respectively. The oil passages are adapted to force the lubricating oil collected at the shallow oil collecting portion toward the deep oil collecting portion and cooperate to facilitate the collection of the lubricating oil.

32 Claims, 3 Drawing Sheets

OIL PAN FOR INTERNAL COMBUSTION ENGINE

BACKGROUND OF THE INVENTION

The present invention relates to an oil pan for an internal combustion engine, which is mounted on an underside of an engine cylinder block, and more specifically to an oil pan having a baffle plate.

Japanese Patent Application First Publication No. 7-42523 discloses an oil pan for an internal combustion engine, which has a double-walled structure including an inner pan and an outer pan with a very small clearance therebetween. Lubricating oil drained from the engine is introduced to the very small clearance to form a thin oil layer therein. Each of the outer and inner pans includes a deep oil collecting portion and a shallow oil collecting portion which are disposed adjacent to each other in a longitudinal direction of the engine. The shallow oil collecting portion is disposed near an engine rotating part such as a crankshaft. A baffle plate extends over the inner-and outer pans to restrain an oil level of the lubricating oil within the oil pan from swinging during operation of a vehicle. The baffle plate has a plurality of oil guide holes through which the lubricating oil dripped from a part, for instance, a crankshaft journal, near the oil pan is collected at the shallow oil collecting portion.

SUMMARY OF THE INVENTION

It will be noted that such a conventional oil pan as the above-described related art is complicated by the double-walled structure and therefore the lubricating oil drained from the engine and the lubricating oil dripped from the adjacent part such as the crankshaft journal are collected at the separate portions, i.e., the clearance between the inner and outer pans and the shallow oil collecting portion of the inner pan. Further, in the conventional oil pan, the baffle plate, except the oil holes thereof, covers the entire shallow oil collecting portion and further no measure is taken for forcing the lubricating oil collected at the shallow oil collecting portion toward the deep oil collecting portion. This will prevent the lubricating oil dripped from the crankshaft journal from being smoothly directed to the deep oil collecting portion via the oil guide holes and the shallow oil collecting portion. In such a case, the lubricating oil within the shallow oil collecting portion tends to be contacted with the crankshaft and stirred thereby. If the lubricating oil is stirred by the contact with the crankshaft, air is undesirably mixed in the lubricating oil. In addition, if the crankshaft is contacted with an oil level of the lubricating oil within the shallow oil collecting portion, friction loss caused by the contact therebetween will be increased.

It is an object of the present invention to provide an oil pan having a simple structure and capable of quickly collecting a lubricating oil at a deep oil collecting portion through a shallow oil collecting portion.

It is a further object of the present invention to provide an oil pan capable of controlling an oil level of the lubricating oil collected at the shallow oil collecting portion so as not to be in contact with an engine rotating part.

According to one aspect of the present invention, there is provided an oil pan for collecting a lubricating oil drained from an internal combustion engine and a lubricating oil dripped from a crankshaft of the engine, said oil pan being disposed near the crankshaft, comprising:

a wall including a first oil collecting portion and a second oil collecting portion that are adapted for collecting the lubricating oils, said first and second oil collecting portions being connected with and adjacent to each other in a longitudinal direction of the engine;

a first baffle plate cooperating with the first oil collecting portion of the wall to define a first oil passage extending along the longitudinal direction of the engine, said first oil passage being disposed downstream of a rotating direction of the crankshaft perpendicular to the longitudinal direction of the engine, said first oil passage having an inlet portion open in a direction opposed to the rotating direction of the crankshaft;

a second baffle plate cooperating with the first oil collecting portion of the wall to define a second oil passage extending along the longitudinal direction of the engine and spaced from the first oil passage in a lateral direction of the engine perpendicular to the longitudinal direction, said oil passage being disposed upstream of the rotating direction of the crankshaft; and a plurality of oil guides guiding the lubricating oil drained from the engine to the first and second oil passages, said plurality of oil guides being disposed on the first and second baffle plates, respectively;

wherein said first and second oil passages are so arranged as to force the lubricating oil collected at the first oil collecting portion toward the second oil collecting portion.

According to a further aspect of the present invention, there is provided an oil pan for collecting a lubricating oil drained from an internal combustion engine and a lubricating oil dripped from a crankshaft of the engine, said oil pan being disposed near the crankshaft, comprising:

a first oil collecting portion for collecting the lubricating oils;

a second oil collecting portion for collecting the lubricating oils, said second oil collecting portion being adjacent to the first oil collecting portion in a longitudinal direction of the engine and connected therewith;

first wall means for defining the first and second oil collecting portions;

a first oil passage extending along the longitudinal direction of the engine and disposed downstream of a rotating direction of the crankshaft perpendicular to the longitudinal direction of the engine, said first oil passage having an inlet portion open in a direction opposed to the rotating direction of the crankshaft;

a second oil passage extending along the longitudinal direction of the engine and spaced from the first oil passage in a lateral direction of the engine perpendicular to the longitudinal direction, said second oil passage being disposed upstream of the rotating direction of the crankshaft;

second wall means cooperating with the first oil collecting portion of the first wall means to define the first oil passage; and third wall means cooperating with the first oil collecting portion of the first wall means to define the second oil passage;

wherein said second and third wall means forcibly guide the lubricating oil collected at the first oil collecting portion toward the second oil collecting portion.

According to a still further aspect of the present invention, there is provided an oil pan for collecting a lubrication oil drained from an internal combustion engine and a lubricating oil dripped from a rotating part of the engine, said oil pan being disposed near the rotating part, comprising:

a first oil collecting portion for collecting the lubricating oils;

a second oil collecting portion for collecting the lubricating oils, said second oil collecting portion being adjacent to the first oil collecting portion in a longitudinal direction of the engine and connected therewith;

first means, downstream of a rotating direction of the rotating part, for enabling the lubricating oil collected at the first oil collecting portion to be introduced thereinto by wind force caused upon rotation of the rotating part and be forced toward the second oil collecting portion; and second means, upstream of the rotating direction of the crankshaft, for preventing the lubricating oil collected at the first oil collecting portion from being influenced by the wind force and for forcing the lubricating oil collected thereat toward the second oil collecting portion;

wherein said first and second means cooperate to facilitate collection of the lubricating oil through the first oil collecting portion and control an oil level of the lubricating oil collected at the first oil collecting portion so as not to be in contact with the rotating part.

DETAILED DESCRIPTION OF THE INVENTION

Referring now to FIGS. 1–4, there is shown an oil pan 10 according to the present invention, which is applicable to a V-type internal combustion engine. The oil pan 10 is adapted to be mounted to an underside of an engine cylinder block. The oil pan 10 is adapted for collecting a lubricating oil drained from the engine and a lubricating oil dripped from an engine part, for instance, a crankshaft journal.

Figure 1:
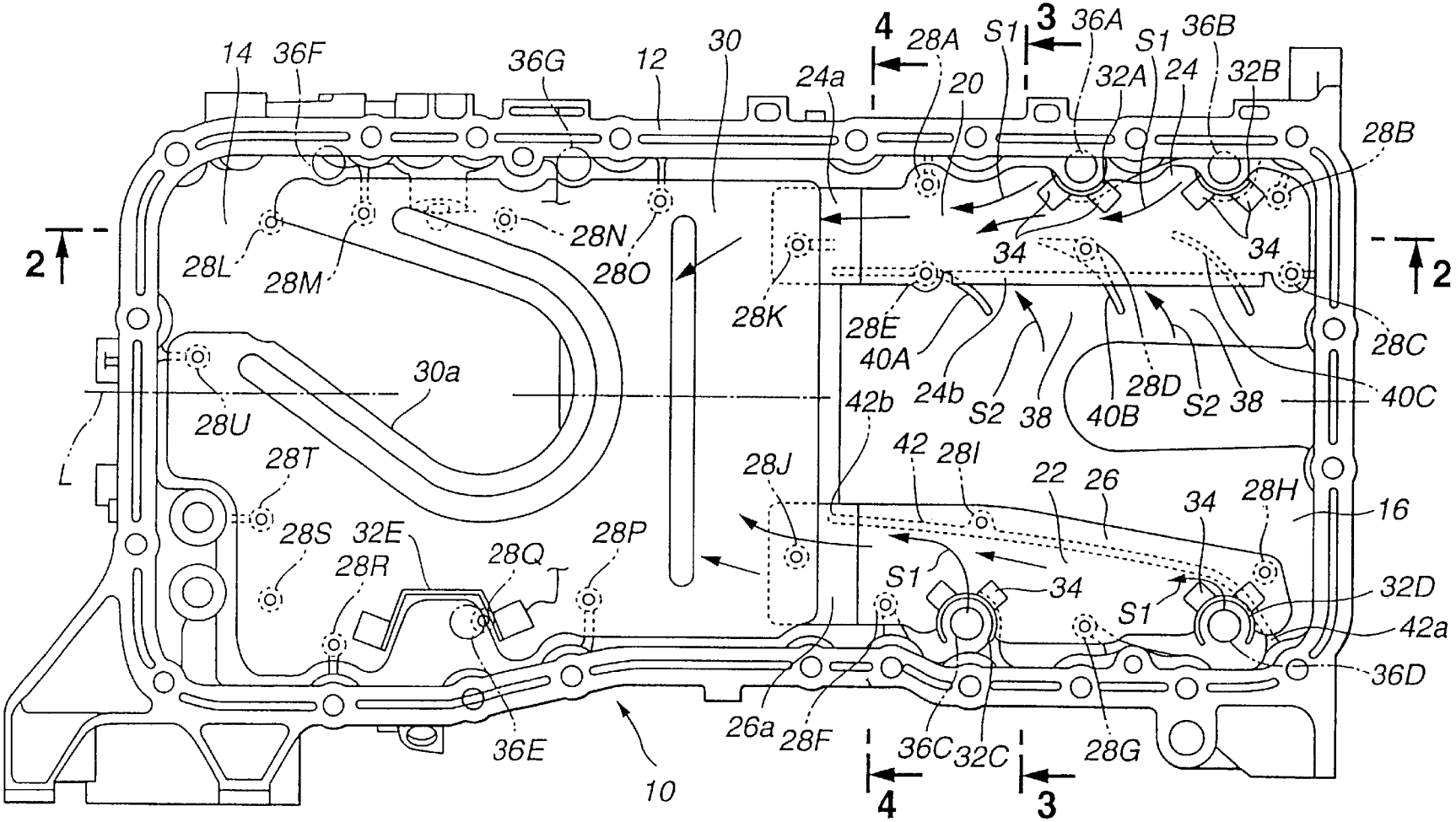
FIG. 1 is a plan view of an oil pan of a first embodiment, according to the present invention.
Figure 2:
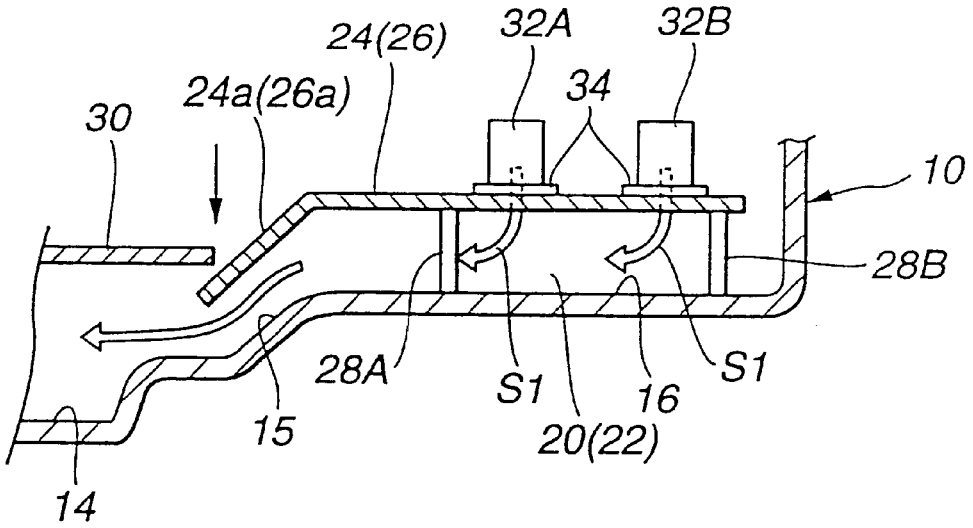
FIG. 2 is a cross section, taken along the line 2—2 of FIG. 1.

As illustrated in FIG. 1, the oil pan 10 is formed with a flange 12 extending along a circumferential periphery of an upper end portion thereof. The oil pan 10 is fixed to the underside of the engine cylinder block by tightening bolts, not shown, at the flange 12. The oil pan 10 includes a deep oil collecting portion 14 and a shallow oil collecting portion 16 that are located adjacent to each other in a longitudinal direction of the engine. The shallow oil collecting portion 16 has a depth smaller than a depth of the deep oil collecting portion 14. The deep oil collecting portion 14 and the shallow oil collecting portion 16 are connected with each other through a sloped intermediate portion 15, as shown in FIG. 2. The oil pan 10 is made of an aluminum alloy. The deep oil collecting portion 14 and the shallow oil collecting portion 16 are integrally formed in this embodiment but may be formed as separate parts and connected together. The deep oil collecting portion 14 includes a generally rectangular and flat bottom wall and a peripheral side wall connected with the bottom wall. Similarly, the shallow oil collecting portion 16 includes a generally rectangular and flat bottom wall and a peripheral side wall connected with the bottom wall. The bottom wall of the shallow oil collecting portion 16 is positioned at a level higher than the bottom wall of the deep oil collecting portion 14, as shown in FIG. 2.

Figure 3:
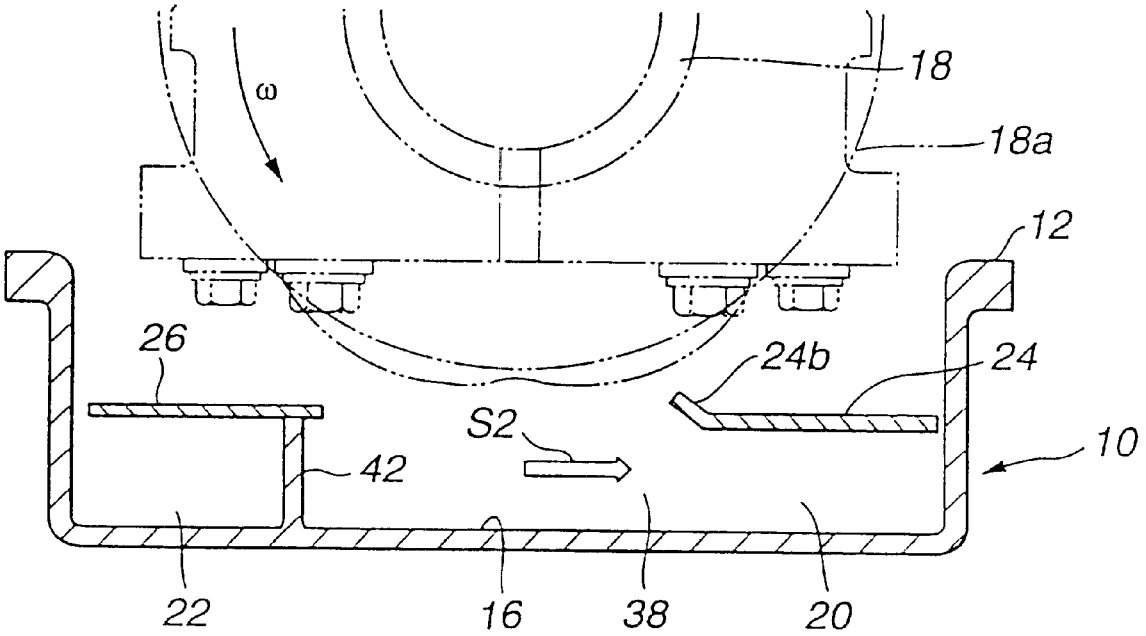
FIG. 3 is a cross section, taken along the line 3—3 of FIG. 1.

As illustrated in FIG. 3, the shallow oil collecting portion 16 is disposed near below an engine rotating part, such as a big end 18*a* of a connecting rod of a crankshaft 18. The arrangement of the shallow oil collecting portion 16 relative to the engine rotating part is made because of a limited installation space in a vertical direction of the engine.

Referring back to FIG. 1, the shallow oil collecting portion 16 includes a first oil passage 20 and a second oil passage 22 on opposed sides of the shallow oil collecting portion 16 in a lateral direction of the engine perpendicular to the longitudinal direction. The oil passages 20 and 22 are spaced from each other in the lateral direction and extend toward the deep oil collecting portion 14 along the longitudinal direction. The oil passage 20 is disposed downstream of a rotating direction ω of the crankshaft 18 and the oil passage 22 is disposed upstream of the rotating direction ω of the crankshaft 18, as shown in FIG. 3. The oil passages 20 and 22 are so arranged as to force the lubricating oil collected at the shallow oil collecting portion 16 toward the deep oil collecting portion 14, as explained hereinafter.

Figure 4:
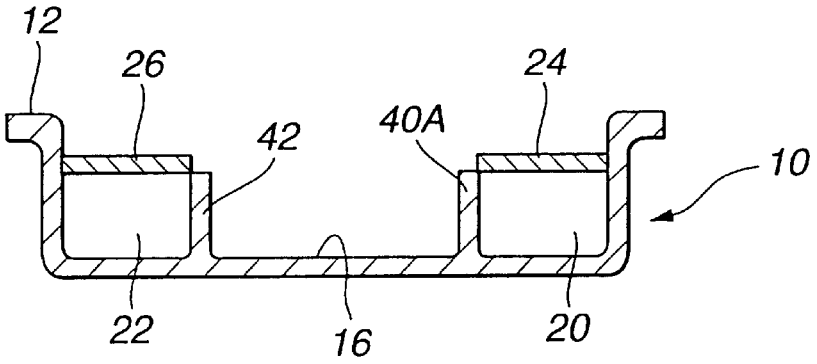
FIG. 4 is a cross section, taken along the line 4—4 of FIG. 1.

The oil passage 20 is defined by a first baffle plate 24, a plurality of guide ribs 40A–40C and the bottom and side walls of the shallow oil collecting portion 16. The oil passage 20 has a generally rectangular shape in cross section, as shown in FIG. 4. Specifically, the first baffle plate 24 is fixed to a lateral side, i.e., an upper side as viewed in FIG. 1, of the shallow oil collecting portion 16, by tightening bolts, not shown, at bosses 28A–28E and 28K. The baffle plate 24 is made of a thin sheet metal and has a generally elongated rectangular shape shown in FIG. 1. The baffle plate 24 extends along the longitudinal direction of the engine over the lateral side portion of the shallow oil collecting portion 16 to cover the lateral side portion thereof. As shown in FIG. 4, the baffle plate 24 covers a trough formed by the guide rib 40A and the bottom and side walls of the shallow oil collecting portion 16. The baffle plate 24 has an underside surface defining an upper periphery of the rectangular oil passage 20. As shown in FIG. 2, the baffle plate 24 has an inclined longitudinal end portion 24*a* inclined downwardly toward the deep oil collecting portion 14 along the sloped intermediate portion 15 between the deep and shallow oil collecting portions 14 and 16. As shown in FIG. 3, the baffle plate 24 also has an inclined lateral-inner flange 24*b* extending laterally inwardly from a lateral-inner side thereof and inclined upwardly. The lateral-inner flange 24*b* serves for positively introducing the lubricating oil dripped onto the shallow oil collecting portion 16 into the oil passage 20 through the inlet portion 38.

In this embodiment, the three guide ribs 40A–40C are spaced from each other in the longitudinal direction of the engine and define therebetween two inlet portions 38 of the oil passage 20. Each inlet portion 38 is open in a direction opposed to the rotating direction ω of the crankshaft 18, as shown in FIG. 3. The guide ribs 40A–40C are integrally formed with the bottom wall of the shallow oil collecting portion 16. The guide ribs 40A–40C extend uprightly from the bottom wall of the shallow oil collecting portion 16 in a spaced and opposed relation to the side wall thereof. The guide ribs 40A–40C act as a lateral-inner wall defining a lateral-inner periphery of the rectangular oil passage 20. The guide ribs 40A–40C are smoothly curved from the inlet portions 38 toward the deep oil collecting portion 14, as shown in FIG. 1. In other words, the guide ribs 40A–40C are curved from the deep oil collecting portion 14 side toward a lateral-central portion of the shallow oil collecting portion 16. Opposed lateral-inner end portions of the adjacent two guide ribs 40A and 40B, and 40B and 40C, cooperate to form the inlet portion 38 therebetween. The lateral-inner end portions of the guide ribs 40A–40C associate with the inclined lateral-inner flange 24*b* of the baffle plate 24 for positive introduction of the lubricating oil. Among the guide ribs 40A–40C, the guide rib 40A is positioned closest to the deep oil collecting portion 14. The guide ribs 40A–40C have upper ends contacted with the underside surface of the baffle plate 24 and support the baffle plate 24 in association with the bosses 28A–28E and 28K. The bosses 28D and 28E are integrally formed with the guide ribs 40A and 40B, respectively.

The oil passage 22 is defined by a second baffle plate 26, a guide rib 42 and the bottom and side walls of the shallow oil collecting portion 16. The oil passage 22 has a generally rectangular shape in cross section as best shown in FIG. 4, similar to the oil passage 20. The second baffle plate 26 is fixed to the opposite lateral side, i.e., a lower side as viewed in FIG. 1, of the shallow oil collecting portion 16, by tightening bolts, not shown, at bosses 28F–28J. The baffle plate 26 is made of a thin sheet metal and has a generally elongated rectangular shape shown in FIG. 1. The baffle plate 26 extends along the longitudinal direction of the engine over the opposite lateral side portion of the shallow oil collecting portion 16 to cover the opposite lateral side portion thereof. As shown in FIG. 4, the baffle plate 26 covers a trough formed by the guide rib 42 and the bottom and side walls of the shallow oil collecting portion 16. The baffle plate 26 has an underside surface defining an upper periphery of the rectangular oil passage 22. As shown in FIG. 2, the baffle plate 26 has an inclined longitudinal end portion 26*a* inclined downwardly toward the deep oil collecting portion 14 along the sloped intermediate portion 15 between the deep and shallow oil collecting portions 14 and 16.

As illustrated in FIG. 1, the guide rib 42 extends along the longitudinal direction of the engine over substantially an entire length of the oil passage 22. The guide rib 42 is inclined relative to a reference line L extending in the longitudinal direction of the engine in such a manner that the guide rib 42 becomes closer to the oil passage 20 as the guide rib 42 extends closer to the deep oil collecting portion 14. The guide rib 42 has one end 42*a* distant from the deep oil collecting portion 14 and connected with the side wall of the shallow oil collecting portion 16. The guide rib 42 also has an opposite end 42*b* located close to the deep oil collecting portion 14. The guide rib 42 is integrally formed with the bottom wall of the shallow oil collecting portion 16. The guide rib 42 extends uprightly from the bottom wall of the shallow oil collecting portion 16 in an opposed and spaced relation to the side wall thereof. The guide rib 42 acts as a lateral-inner wall defining a lateral-inner periphery of the rectangular oil passage 22, as shown in FIG. 4. The guide rib 42 has an upper end contacted with the underside surface of the baffle plate 26 and supports the baffle plate 26 together with the bosses 28F–28J. The boss 28I is integrally formed with the guide rib 42.

There is a lateral-central area of the shallow oil collecting portion 16, which is prevented from being covered with a baffle plate. The lateral-central area of the shallow oil collecting portion 16 is exposed to the big end 18*a* of the connecting rod of the crankshaft 18, as shown in FIG. 3.

A third baffle plate 30 extends over the deep oil collecting portion 14. The baffle plate 30 is fixed to the deep oil collecting portion 14 by tightening bolts, not shown, at the bosses 28J–28U. The baffle plate 30 is formed with a cutout 30*a* for preventing conflict with a suction pipe, not shown. The baffle plate 30 thus covers substantially an entire area of the deep oil collecting portion 14 to restrain an oil level of the lubricating oil collected at the deep oil collecting portion 14 from swinging during operation of the vehicle. As illustrated in FIG. 2, the baffle plate 30 is located at a level lower than a general surface of each baffle plate 24 and 26. In this embodiment, the baffle plate 30 is separately formed from the baffle plates 24 and 26. The baffle plate 30 extends over lower ends of the inclined longitudinal end portions 24*a* and 26*a* of the baffle plates 24 and 26. The baffle plate 30 may extend over the lower end portion 24*a* or 26*a* of at least one of the baffle plates 24 and 26.

A plurality of oil guides, four oil guides 32A–32D in this embodiment, are mounted onto the lateral-outer sides of the baffle plates 24 and 26 through flanges 34. The oil guides 32A–32D are in the form of a generally tubular shape extending upwardly as shown in FIG. 2. The oil guides 32A and 32B have lower ends open into the oil passage 20 through the baffle plate 24, respectively. The oil guides 32C and 32D have lower ends open into the oil passage 22 through the baffle plate 26, respectively. The oil guides 32A–32D are arranged to be opposed to oil drain holes indicated at 36A–36D in FIG. 1, which are formed in the engine parts such as an engine cylinder head and an engine cylinder block. The oil guides 32A–32D are effective to guide the lubricating oil drained through the oil drain holes 36A–36D to the oil passages 20 and 22. Oil drain holes 36E–36G of the engine parts are located above the deep oil collecting portion 14. An oil guide 32E for the oil drain hole 36E is mounted onto the baffle plate 30. The oil guide 32E has a generally reversed U-shape as shown in FIG. 1. Meanwhile, the V-type engine, to which the oil pan of this embodiment is applied, has engine cylinder heads on the laterally opposed sides and a main oil gallery on the lateral-central portion. The oil drain holes 36A–36G, therefore, are arranged on the laterally opposed sides of the V-type engine.

The thus-constructed oil pan collects the lubricating oil in the following manner.

The lubricating oil drained from the engine parts through the oil drain holes 36A–36D flows into the oil passages 20 and 22 through the oil guides 32A–32D, as indicated by arrows S1 in FIGS. 1 and 2. The lubricating oils passing through the oil passages 20 and 22, respectively, are forced toward the deep oil collecting portion 14 and gathered thereat. The lubricating oil drained from the engine parts through the oil drain holes 36E–36G flows directly or through the oil guide 32E into the deep oil collecting portion 14 and collected thereat.

On the other hand, the lubricating oil dripped from the engine parts, such as the crankshaft journal, onto the shallow oil collecting portion 16 is introduced into the oil passage 20 through the inlet portion 38 by the wind force caused upon rotation of the crankshaft 18. Namely, the crankshaft 18 rotates at high speed in the direction ω shown in FIG. 3, in the crankcase, so that an air stream is produced along the rotating direction ω in the crankcase. The air stream pushes the lubricating oil dripped onto the shallow oil collecting portion 16, whereby there is generated a flow of the lubricating oil having a velocity vector along the lateral direction of the engine, as indicated by arrows S2 in FIGS. 1 and 3. The lubricating oil is urged to enter the oil passage 20 through the inlet portion 38, passing through the oil passage 20. The lubricating oil is thus forced toward the deep oil collecting portion 14 and collected thereat.

As be appreciated from the above description, the oil passages 20 and 22 cooperate to facilitate the collection of the lubricating oil through the shallow oil collecting portion 16. The oil passages 20 and 22 force the lubricating oil drained from the engine parts through the oil drain holes 36A–36D to quickly flow into the deep oil collecting portion 14. This can reduce a period at which the lubricating oil stays at the shallow oil collecting portion 16, so that an oil mist produced in the crankcase can be reduced. Further, an oil level of the lubricating oil collected at the lateral-central area of the shallow oil collecting portion 16 can be controlled so as not to be in contact with the rotating part of the crankshaft 18 and stirred thereby. As a result, the air density within the crankcase can be kept low and the friction loss caused by the contact of the rotating part of the crankshaft 18 with the oil level of the lubricating oil can be reduced.

The oil passage 20 can be effective to force both of the lubricating oils dripped onto the shallow oil collecting portion 16 and drained through the oil guides 32A and 32B toward the deep oil collecting portion 14. The arrangement of the oil passage 20 is contributes to the simple structure of the oil pan 10.

The inlet portion 38 of the oil passage 20, that is open in the direction opposed to the rotating direction ω of the crankshaft 18, can trap the lubricating oil dripped onto the shallow oil collecting portion 16 in the assistance of the air stream produced along the rotating direction ω of the crankshaft 18. As a result, the period at which the lubricating oil stays at the shallow oil collecting portion 16 can be more reduced.

Further, the guide ribs 40A–40C can impart such a proper vector as to direct toward the deep oil collecting portion 14 to the lubricating oil introduced through the inlet portion 38. The lubricating oil is thus urged to quickly flow toward the deep oil collecting portion 14. This can improve the oil collecting rate at the shallow oil collecting portion 16.

The oil passage 22 is disposed upstream of the rotating direction ω of the crankshaft 18 and the guide rib 42 acts as a partition wall for separating the oil passage 22. The lubricating oil introduced into the oil passage 22 through the oil guides 32C and 32D can be prevented from being influenced by the wind force caused upon rotation of the crankshaft 18 in the direction ω. The lubricating oil introduced into the oil passage 22 can be forced toward the deep oil collecting portion 14 without being pushed by the wind force downstream of the rotating direction ω of the crankshaft 18. The lubricating oil can also be restrained from being excessively collected upstream of the rotating direction ω of the crankshaft 18. This results in restricting an oil level of the lubricating oil collected upstream of the rotating direction ω of the crankshaft 18, to a lower level. Further, the guide rib 42 inclined relative to the longitudinal reference line L can properly change the velocity vector of the flow of the lubricating oil passing through the oil passage 22. This causes the flow of the lubricating oil to be quickly and smoothly directed toward the deep oil collecting portion 14. The period at which lubricating oil stays at the shallow oil collecting portion 16, therefore, can be reduced.

Furthermore, with the above-described arrangement of the baffle plate 30 relative to the baffle plates 24 and 26, the lubricating oils passing through the oil passages 20 and 22, respectively, can be positively introduced into the deep oil collecting portion 14 along below the end portions 24*a* and 26*a* of the baffle plates 24 and 26, without flowing onto the baffle plate 30. To this end, it is assured that the oil level of the lubricating oil collected at the shallow oil collecting portion 16 is controlled so as not to be in contact with the rotating part of the crankshaft 18 and stirred thereby.

Figure 5:
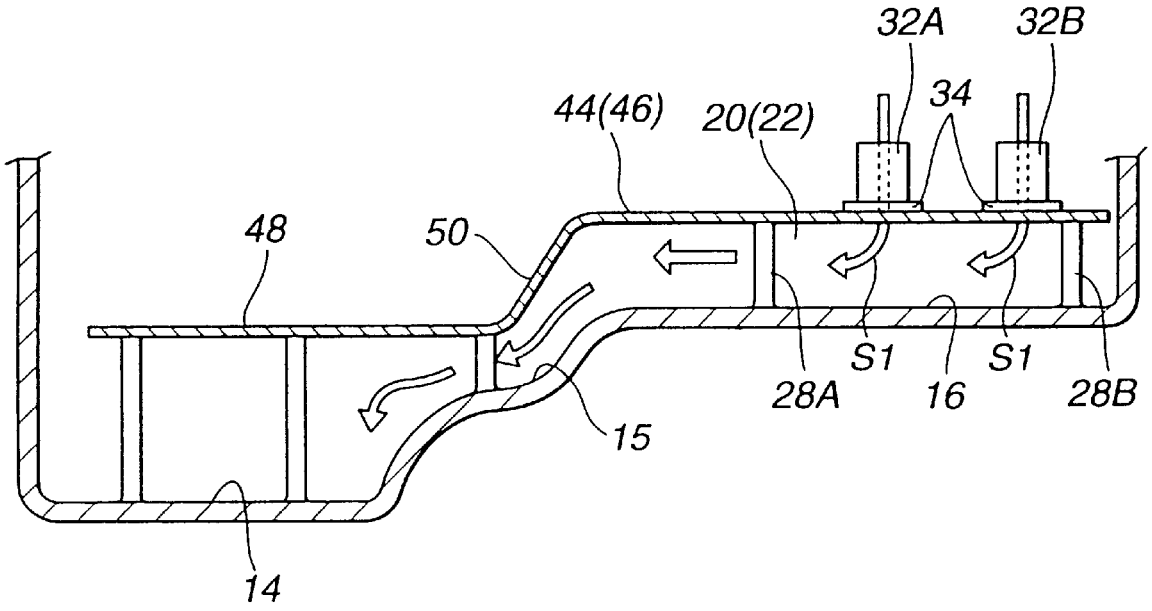
FIG. 5 is a cross section similar to FIG. 2, but showing the oil pan of a second embodiment, according to the present invention.

Referring to FIG. 5, the oil pan of the second embodiment, according to the invention, will be explained hereinafter. The oil pan of the second embodiment is similar to that of the first embodiment except that three baffle plates are integrally formed. Like reference numbers denote like parts, and therefore, detailed explanations therefor can be omitted.

As illustrated in FIG. 5, the integral baffle plate includes first and second baffle plate portions 44 and 46 forming the oil passages 20 and 22, respectively, and a third baffle plate portion 48 covering the deep oil collecting portion 14. A sloped intermediate portion 50 is interposed between the baffle plate portions 44 and 46 and the baffle plate portion 48. The sloped intermediate portion 50 is downwardly inclined toward the deep oil collecting portion 14. The integral baffle plate is in the form of a thin sheet metal.

The arrangement of this embodiment can exhibit same effects as the effects of the first embodiment and reduce the number of parts of the oil pan. In addition, an oil pan using the integral baffle plate is suitably applicable to an internal combustion engine having a relatively small size. If it is difficult to apply the oil pan using the integral baffle plate to a relatively large-sized internal combustion engine, an oil pan having the separate baffle plates 24, 26 and 30 of the first embodiment may be applied thereto.

This application is based on Japanese Patent Application No. 11-126756, filed on May 7, 1999, the entire contents of which, inclusive of the specification, claims and drawings, are hereby incorporated by reference herein.

Although the invention has been described above by reference to certain embodiments of the invention, the invention is not limited to the embodiments described above. Modifications and variations of the embodiment described above will occur to those skilled in the art, in light of the above teachings. The scope of the invention is defined with reference to the following claims.

What is claimed is:

1. An oil pan for collecting a lubricating oil drained from an internal combustion engine and a lubricating oil dripped from a crankshaft of the engine, said oil pan being disposed near the crankshaft, comprising:

a wall including a first oil collecting portion and a second oil collecting portion that are adapted for collecting the lubricating oils, said first and second oil collecting portions being connected with and adjacent to each other in a longitudinal direction of the engine;

a first baffle plate cooperating with the first oil collecting portion of the wall to define a first oil passage extending along the longitudinal direction of the engine, said first oil passage being disposed downstream of a rotating direction of the crankshaft perpendicular to the longitudinal direction of the engine, said first oil passage having an inlet portion open in a direction opposed to the rotating direction of the crankshaft;

a second baffle plate cooperating with the first oil collecting portion of the wall to define a second oil passage extending along the longitudinal direction of the engine and spaced from the first oil passage in a lateral direction of the engine perpendicular to the longitudinal direction, said oil passage being disposed upstream of the rotating direction of the crankshaft; and a plurality of oil guides guiding the lubricating oil drained from the engine to the first and second oil passages, said plurality of oil guides being disposed on the first and second baffle plates, respectively;

wherein said first and second oil passages are so arranged as to force the lubricating oil collected at the first oil collecting portion toward the second oil collecting portion.

2. An oil pan as claimed in claim 1, wherein said wall includes a plurality of first guide ribs cooperating with the first oil collecting portion and the first baffle plate to form the first oil passage, said plurality of first guide ribs being spaced in the longitudinal direction of the engine and defining the inlet portion of the first oil passage therebetween.

3. An oil pan as claimed in claim 2, wherein said first guide ribs are curved from the inlet portion toward the second oil collecting portion, said first guide ribs including opposed end portions cooperating to form the inlet portion of the first oil passage.

4. An oil pan as claimed in claim 2, wherein said wall includes a second guide rib cooperating with the first oil collecting portion and the second baffle plate to form the second oil passage, said second guide rib extending along the longitudinal direction of the engine over substantially an entire length of the second oil passage.

5. An oil pan as claimed in claim 4, wherein said second guide rib is inclined relative to a reference line in the longitudinal direction of the engine such as to be closer to the first oil passage as extending closer to the second oil collecting portion.

6. An oil pan as claimed in claim 4, wherein said first baffle plate includes a lateral-inner flange inclined so as to positively introduce the lubricating oil downstream of the rotation direction of the crankshaft into the first oil passage through the inlet portion.

7. An oil pan as claimed in claim 1, further comprising a third baffle plate c covering the second oil collecting portion.

8. An oil pan as claimed in claim 7, wherein said third baffle plate extends over a longitudinal end portion of at least one of the first and second baffle plates.

9. An oil pan as claimed in claim 7, wherein said third baffle plate is disposed at a level lower than a general surface of each of the first and second baffle plates.

10. An oil pan as claimed in claim 7, wherein said third baffle plate is separately formed from the first and second baffle plates.

11. An oil pan as claimed in claim 7, wherein said third baffle plate is integrally formed with the first and second baffle plates.

12. An oil pan as claimed in claim 1, wherein said first oil collecting p portion is smaller in depth than the second oil collecting portion.

13. An oil pan for collecting a lubricating oil drained from an internal combustion engine and a lubricating oil dripped from a crankshaft of the engine, said oil pan being disposed near the crankshaft, comprising:

a first oil collecting portion for collecting the lubricating oils;

a second oil collecting portion for collecting the lubricating oils, said second oil collecting portion being adjacent to the first oil collecting portion in a longitudinal direction of the engine and connected therewith;

first wall means for defining the first and second oil collecting portions;

a first oil passage extending along the longitudinal direction of the engine and disposed downstream of a rotating direction of the crankshaft perpendicular to the longitudinal direction of the engine, said first oil passage having an inlet portion open in a direction opposed to the rotating direction of the crankshaft;

a second oil passage extending along the longitudinal direction of the engine and spaced from the first oil passage in a lateral direction of the engine perpendicular to the longitudinal direction, said second oil passage being disposed upstream of the rotating direction of the crankshaft;

second wall means cooperating with the first oil collecting portion of the first wall means to define the first oil passage; and third wall means cooperating with the first oil collecting portion of the first wall means to define the second oil passage;

wherein said second and third wall means forcibly guide the lubricating oil collected at the first oil collecting portion toward the second oil collecting portion.

14. An oil pan as claimed in claim 13, wherein said second wall means includes a baffle plate extending over the first oil collecting portion on along the longitudinal direction of the engine.

15. An oil pan as claimed in claim 14, wherein said baffle plate includes a lateral-inner flange inclined so as to positively introduce the lubricating oil downstream of the rotation direction of the crankshaft into the first oil passage through the inlet portion.

16. An oil pan as claimed in claim 14, wherein said second wall means includes a plurality of guide ribs curved toward the second oil collecting portion and extending uprightly from the first oil collecting portion.

17. An oil pan as claimed in claim 16, wherein said guide ribs are spaced from each other in the longitudinal direction of the engine to form the inlet portion therebetween.

18. An oil pan as claimed in claim 14, wherein said third wall means includes a second baffle plate extending over the first oil collecting portion along the longitudinal direction of the engine, said second baffle plate being spaced from the first baffle plate in the lateral direction of the engine.

19. An oil pan as claimed in claim 18, wherein said third wall means includes a guide rib extending along the longitudinal direction of the engine and uprightly from the first oil collecting portion, said guide rib being inclined relative to a reference line in the longitudinal direction so as to be closer to the first oil passage as extending closer to the second oil collecting portion.

20. An oil pan as claimed in claim 18, further comprising guide means for guiding the lubricating oil drained from the engine to the first and second oil passages.

21. An oil pan as claimed in claim 20, wherein said guide means include a plurality of oil guides disposed on the first and second baffle plates.

22. An oil pan as claimed in claim 18, further comprising cover means for covering the second oil collecting portion.

23. An oil pan as claimed in claim 22, wherein said cover means includes a third baffle-plate covering the second oil collecting portion.

24. An oil pan as claimed in claim 23, wherein said third baffle plate covers an end portion of at least one of the first and second baffle plates.

25. An oil pan as claimed in claim 23, wherein said third baffle plate is disposed at a level lower than general surfaces of the first and second baffle plates.

26. An oil pan as claimed in claim 23, wherein said third baffle plate is separately formed from the first and second baffle plates.

27. An oil pan as claimed in claim 23, wherein said third baffle plate is integrally formed with the first and second baffle plates.

28. An oil pan as claimed in claim 13, wherein said first oil collecting portion is smaller in depth than the second oil collecting portion.

29. An oil pan for collecting a lubrication oil drained from an internal combustion engine and a lubricating oil dripped from a rotating part of the engine, said oil pan being disposed near the rotating part, comprising:

a first oil collecting portion for collecting the lubricating oils;

a second oil collecting portion for collecting the lubricating oils, said second oil collecting portion being adjacent to the first oil collecting portion in a longitudinal direction of the engine and connected therewith;

first means, downstream of a rotating direction of the rotating part, for enabling the lubricating oil collected at the first oil collecting portion to be introduced thereinto by wind force caused upon rotation of the rotating part and be forced toward the second oil collecting portion; and second means, upstream of the rotating direction of the crankshaft, for preventing the lubricating oil collected at the first oil collecting portion from being influenced by the wind force and for forcing the lubricating oil collected thereat toward the second oil collecting portion;

wherein said first and second means cooperate to facilitate collection of the lubricating oil through the first oil collecting portion and control an oil level of the lubricating oil collected at the first oil collecting portion so as not to be in contact with the rotating part.

30. An oil pan as claimed in claim 29, wherein said first and second means cooperate to define an area therebetween exposed to the rotating part, said oil level being located at the area.

31. An oil pan as claimed in claim 29, wherein said first means includes an inlet portion open in a direction opposed to the rotating direction of the rotating part, said inlet portion being curved toward the second oil collecting portion.

32. An oil pan as claimed in claim 29, further comprising cover means for covering the second oil collecting portion, said cover means cooperating with the first and second means.

* * * * *